US005893607A

United States Patent [19]

Trimnell

[11] Patent Number: 5,893,607

[45] Date of Patent: Apr. 13, 1999

[54] CHAIR ATTACHED COMPUTER KEYBOARD HOLDER

[76] Inventor: Ralph R. Trimnell, 109 N. Kenilworth, Oak Park, Ill. 60301

[21] Appl. No.: 08/918,351

[22] Filed: Aug. 26, 1997

[51] Int. Cl.[6] ..... A47B 83/02

[52] U.S. Cl. ..... 297/170; 297/174; 297/411.23; 297/411.37; 108/27; 108/49; 248/118; 248/285.1; 248/295.11

[58] Field of Search ..... 297/170, 172, 297/174, 411.23, 411.26, 411.3, 411.31, 411.32, 411.33, 411.35, 411.36, 411.37, 411.24, 411.2; 248/226.11, 221.61, 295.11, 285.1, 118; 108/49, 27

[56] References Cited

U.S. PATENT DOCUMENTS

| | | | |
|---|---|---|---|
| 97,831 | 12/1869 | Swett | 248/295.11 |
| 289,384 | 12/1883 | Byrkit | 297/170 X |
| 331,149 | 11/1885 | McClure | 297/170 |
| 366,525 | 7/1887 | Taliaferro | 297/170 |
| 414,392 | 11/1889 | Findley | 297/170 X |
| 564,044 | 7/1896 | Berkemeyer | 297/170 |
| 598,895 | 2/1898 | Bell | 297/170 X |
| 689,758 | 12/1901 | Shaw | 297/170 |
| 2,026,011 | 12/1935 | Wright | 108/49 X |
| 2,193,647 | 3/1940 | Rush et al. | 108/49 |
| 2,535,112 | 12/1950 | Woody | 108/49 X |
| 2,612,422 | 9/1952 | Sarkus | 108/49 X |
| 2,692,806 | 10/1954 | Grace | 108/49 X |
| 2,954,955 | 10/1960 | Feller | 297/170 |
| 3,033,627 | 5/1962 | Brown et al. | 108/49 X |
| 3,054,122 | 9/1962 | Sarkus | 108/49 |
| 3,265,436 | 8/1966 | Bombard et al. | 297/411.23 X |
| 3,311,411 | 3/1967 | Page et al. | 297/170 |
| 3,543,312 | 12/1970 | Pofferi | 108/49 |
| 3,565,484 | 2/1971 | Dargelo | 297/411 |
| 3,698,325 | 10/1972 | Weir | 108/49 X |
| 3,717,375 | 2/1973 | Slobodan | 297/174 X |
| 3,869,106 | 3/1975 | Gregor | 108/27 X |
| 4,500,134 | 2/1985 | Kaniko et al. | 297/170 |
| 4,558,553 | 12/1985 | Kolk | 108/27 |
| 4,566,732 | 1/1986 | Ostergaard, II et al. | 297/174 |
| 4,779,922 | 10/1988 | Cooper | 297/188 |
| 4,815,688 | 3/1989 | Wood | 248/118 X |
| 5,026,114 | 6/1991 | Miller | 108/49 X |
| 5,104,073 | 4/1992 | Vanbeek | 248/118.3 |
| 5,144,898 | 9/1992 | Posly | 108/49 X |
| 5,169,210 | 12/1992 | Fricano | 297/170 X |
| 5,293,825 | 3/1994 | Cauffiel | 108/49 |
| 5,311,210 | 5/1994 | O'Brien | 345/168 |
| 5,452,950 | 9/1995 | Crenshaw | 312/223.3 |
| 5,479,865 | 1/1996 | Cauffiel | 108/49 X |
| 5,490,710 | 2/1996 | Dearing | 297/162 |
| 5,516,021 | 5/1996 | Douglass | 248/285.1 X |
| 5,606,918 | 3/1997 | Cauffiel | 108/49 X |
| 5,612,718 | 3/1997 | Bryan | 297/411.37 X |
| 5,653,499 | 8/1997 | Goodall | 297/170 |
| 5,765,911 | 6/1998 | Sorenson | 297/170 X |
| 5,775,654 | 7/1998 | Price | 248/231.61 |

FOREIGN PATENT DOCUMENTS

| | | | |
|---|---|---|---|
| 486294 | 9/1952 | Canada | 297/411.23 |

*Primary Examiner*—Peter M. Cuomo
*Assistant Examiner*—Rodney B. White
*Attorney, Agent, or Firm*—Don Moyer

[57] ABSTRACT

The holder has a base which can be rotatably attached to at least one chair leg, where the chair leg can be a leg of a star-based chair, a leg of a four-legged chair, an upright of a wheel chair, and analogous members of other chairs. An adjustable height arm is rotatably attached to the base, and a deck for holding a keyboard is rotatably attached to the arm. The holder can be adjusted easily in height, distance from the person using the holder, and angle of the deck, and the holder can easily swing away for easy access to the chair.

4 Claims, 2 Drawing Sheets

FIG. 1
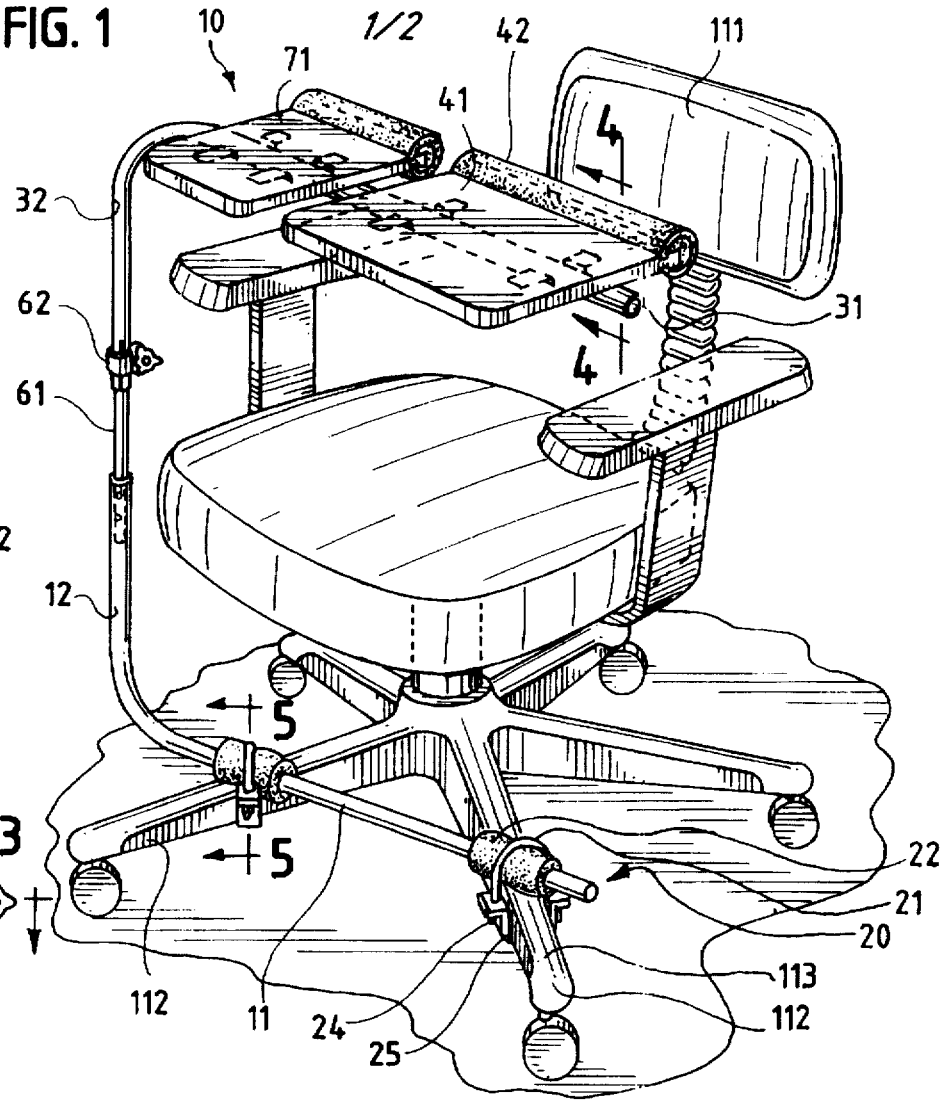
FIG. 2
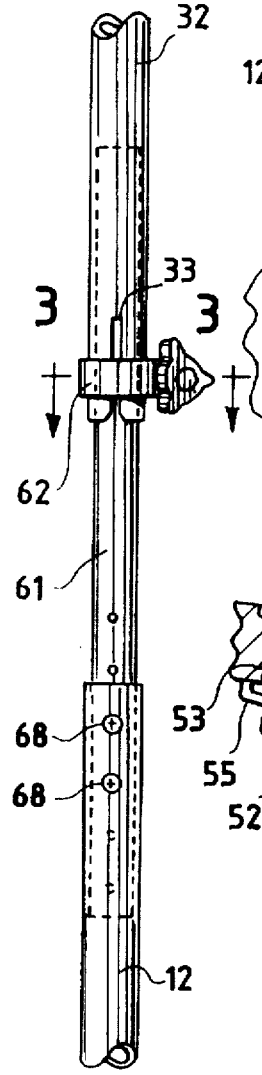
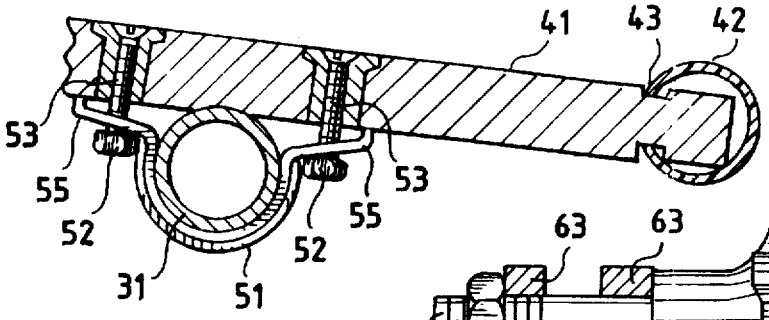
FIG. 4
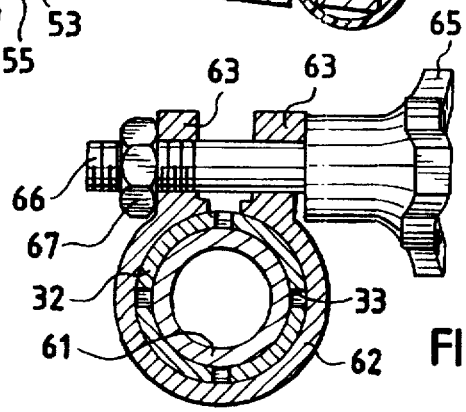
FIG. 3

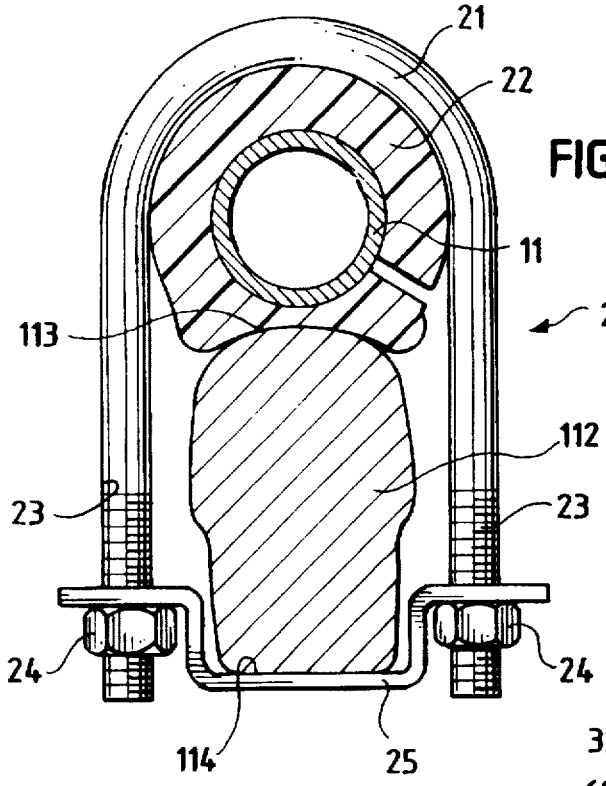
FIG. 5
FIG. 7
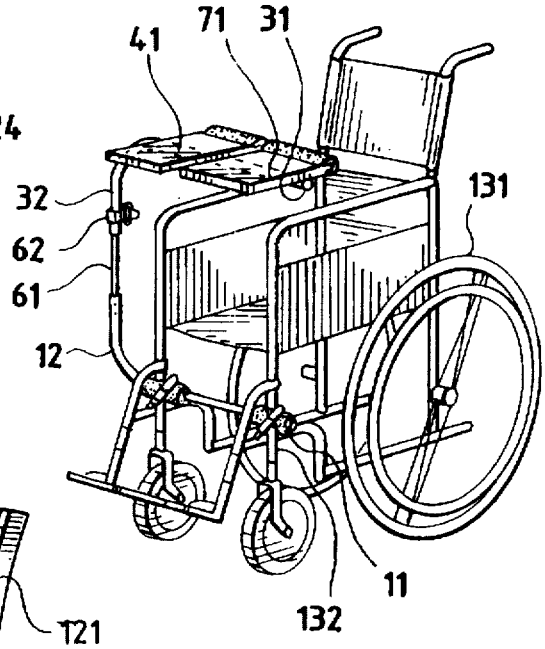
FIG. 6
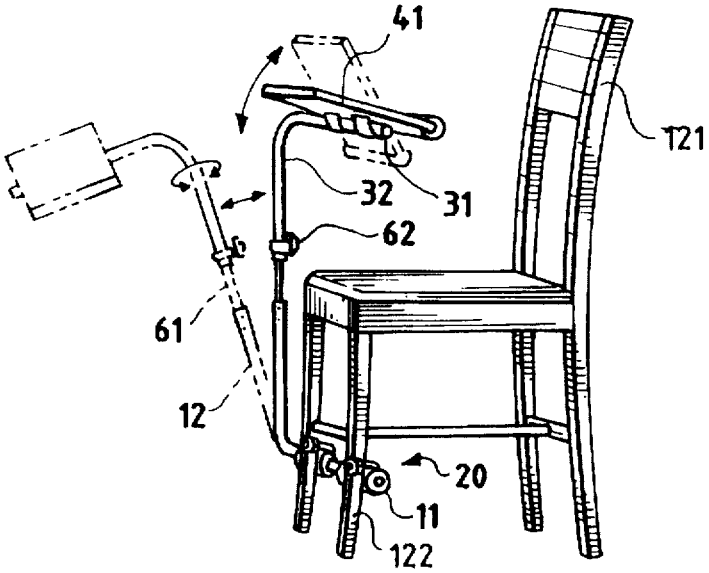

CHAIR ATTACHED COMPUTER KEYBOARD HOLDER

BACKGROUND

The invention is a holder for a computer keyboard, this holder being attached to a chair leg, where the chair leg can be a leg of a typical star-base office chair, a leg of a typical four-legged chair, an upright of a wheelchair, and an analogous member of other chairs.

People choose their work chair for various reasons—to fit their physical needs, their conditions of work, and their method of work and for ornamental appearance for example. Since physical needs, conditions of work, methods of work, and taste vary widely there is wide variation in work chairs which people prefer to use. The work chair preferred however may not fit with the requirements set by a work surface—the requirements of a computer keyboard for example. One solution is to devise a keyboard holder which can be attached to the work chairs which people chose and to make the holder adjustable to suit the wide range of requirements of people using keyboards. This solution is not suggested in prior art.

Several kinds of devices for holding a computer keyboard which are connected to a chair are shown in prior art. In U.S. Pat. No. 4,779,922 Cooper shows a specially constructed chair which has a computer workstation built into the chair. In U.S. Pat. No. 5,104,073 VanBeek shows a device for holding a keyboard in front of a chair so that the keyboard user will experience less repetitive stress damage. In U.S. Pat. No. 5,311,210 O'Brien shows a specially designed chair with a specially designed keyboard built into the chair also intended to reduce damage from repetitive stress. In U.S. Pat. No. 5,452,950 Crenshaw shows a computer workstation incorporated into a school desk. In U.S. Pat. No. 5,490,710 Dearing shows a specially designed chair with a keyboard holder built into the chair arm. None of these designs can be attached to the broad range of chairs which people might choose to suit their particular physical needs, conditions of work, methods of work, and taste.

Thus there is a need for a keyboard holder which can be attached easily to typical work chairs which people using keyboards choose to suit their particular requirements, wherein the keyboard holder itself can be adjusted easily by the person using the keyboard to suit their own particular requirements.

SUMMARY

Objects of this invention comprise requirements listed in the following imperatives. Make a computer keyboard holder which can be attached easily to a typical work chair leg, where the chair leg can be a leg of a star-based chair, a leg of a four-legged chair, an upright of a wheel chair, and analogous elements of other chairs. Make a chair attached keyboard holder which can be adjusted easily in height, distance from keyboard user, and in angle of keyboard, and which can swing away from the chair to give the keyboard user easy access in and out of the chair. Make a keyboard holder which can also hold auxiliary items such as a mouse pad. Achieve these functions with a minimum of parts which are low cost, reliable, easy to manufacture, easy to package, easy to assemble, and easy to use.

Other objects will be comprehended in the drawings and detailed description, which will make additional objects obvious hereafter to persons skilled in the art.

In summary, one embodiment of this keyboard holder has a base which is rotatably attachable to at least one chair leg, has an adjustable height arm rotatably attached to the base, and has a deck for holding a keyboard rotatably attached to the arm.

Other equivalent embodiments will be comprehended in the drawings and detailed description, which will make additional equivalent embodiments obvious hereafter to persons skilled in the art.

DRAWINGS

In the drawings:

FIG. 1 shows the key board holder attached to legs of a star-base work chair.

FIG. 2 shows the connections between the holder base upward portion and the holder arm downward portion.

FIG. 3 shows the clamp rotatably attaching the holder base upward portion and the holder arm downward portion looking across line 3—3 in FIG. 2.

FIG. 4 shows details of the deck rotatably attached to the holder arm horizontal portion looking across line 4—4 in FIG. 1.

FIG. 5 shows details of the clamp rotatably attaching the holder base to a leg of a chair looking across line 5—5 in FIG. 1.

FIG. 6 shows the holder attached to legs of a four-leg chair.

FIG. 7 shows the holder attached to legs of a wheelchair.

DETAILED DESCRIPTION

The holder 10 is shown in FIG. 1 attached to legs 112 of a star-base work chair 111. The holder has a base which has a base horizontal portion 11 rotatably attached to two of the legs 112. Abase upward portion 12 is attached to the base horizontal portion. The base horizontal portion 11 is rotatably attached to the leg 112 by means of a base clamp 20 best shown in FIG. 5. The base clamp 20 has an arc portion 21 terminated by two threaded straight portions 23. A strap 25 is attached to the threaded straight portions by bolts 24. A split, resilient sleeve 22 encircles the base horizontal portion 11, the arc portion 21 partly encircles the sleeve, the sleeve rests on the leg top 113, and the strap 25 is tightened against the leg bottom 114 by tightening the bolts 24. The bolts are tightened so that the base horizontal portion 11 can be rotated within the sleeve manually to a position selected by a user and will remain in the selected position when subjected to forces produced by normal keyboard use.

The holder also has an arm which has an arm horizontal portion 31 and which has an arm downward portion 32 attached to the arm horizontal portion. The arm downward portion is rotatably and movably attached to the base upward portion 12. A deck 41—which can hold a computer keyboard (not shown) and can hold other items of analogous size and weight—is rotatably attachable to the arm horizontal portion 31. The deck has a deck edge 42 which is attached in a slot 43 in the deck. The deck edge is also a wrist rest. Threaded portions of flat head bolts 53 pass through counter sunk holes through the deck and pass through holes through wings 55 in a round clamp 51 which partly encircles the arm 31. The deck is rotatably attached to the arm horizontal portion 31 by tightening arm clamp nuts 52 on the counter sunk bolts 53. The nuts are tightened so that the deck can be rotated about the arm horizontal portion manually to an angle selected by the user and will remain at the selected angle when subjected to forces produced by normal keyboard use.

An extender 61 is fixedly attached to the base upward portion 12 by screws 68. There is a split 33 at the end of the arm downward portion 32 and an end clamp 62 around the arm downward portion at the split as shown in FIG. 2 and FIG. 3. The end clamp 62 mostly encircles the arm downward portion 32, and the arm downward portion encircles the extender 61 so that the arm downward portion is rotatably and movably attachable to the extender, and, thus, rotatably and movably attachable to the base upward portion 12. A threaded portion 66 of a knob 65 passes through holes through tabs 63 on the end clamp. The arm is rotatably and movably attached to the base by tightening the knob against a nut 67 on the knob threaded end. The knob can easily loosen the end clamp so that the arm downward portion 32 can be moved along the extender 61. The knob is then tightened so that the arm horizontal portion 31 can be manually rotated about the base upward portion to a position selected by the user and will remain at the selected position when subjected to forces produced by normal keyboard use.

A second, auxiliary deck 71 having features like those of the deck 41 can be rotatably attached to the arm horizontal portion in the same manner as the deck 41. A computer mouse pointing device can be used on the second deck so it is convenient to be able to position the second deck at an angle different from that of the keyboard deck. A third, auxiliary deck (not shown) could also be rotatably attached in the same manner as the second, auxiliary deck.

FIG. 6 shows how the base horizontal portion 11 can be rotatably attached to legs 122 of a four-legged chair 121, and FIG. 7 shows how the base horizontal portion can be rotatably attached to an upright 132 of a wheelchair 131. The upright 132 is equivalent to the chair legs 112 and 122. In general an equivalent to the legs shown here can be found in other chairs and seating devices so that the base horizontal portion can be attached to have the function specified here. The base clamp 20 can also be used to attach the base horizontal portion to these chair legs, 122 and 132, and can be used to attach the base horizontal portion to any analogous chair member. FIG. 6 also shows the three rotations - of the base horizontal portion about a horizontal axis, of the arm downward portion about the base upward portion, and of the keyboard deck about the arm horizontal portion.

In FIG. 7 the positions of the decks are reversed in order to show that the user can chose these positions. In FIG. 6 the second deck is not used, again at the option of the user. The figures show the base upward portion and the arm downward portion positioned so that they will be at the right hand side of a person using the holder because most users will be right handed and produce more force on this side. The holder can equally well be rotatably attached to the chair leg so that the base upward portion and the arm downward portion will be at the left hand side of a person using the holder. A user who produces extraordinary forces while using a computer keyboard can attach an adjustable length brace between the arm and the chair, or could attach an adjustable length leg between the arm and the floor. In the figures the base horizontal portion is shown attached to two legs of the chairs because this requires only simple clamps. Equivalently, persons skilled in the art could devise clamps so that the base horizontal portion could be rotatably attached to only one leg.

Many equivalent variations of the basic structure and many added features are possible. Other equivalent forms for the base, the arm, and the deck and other equivalent means for attaching the base, the arm, and the deck to provide the functions specified here will be obvious hereafter to persons skilled in the art. Therefore this invention is not limited to the particular examples shown and described here.

I claim:

1. In combination with a chair, the chair having a first chair leg and having a second chair leg, a holder comprising:

a first base clamp, the first base clamp being attached to the first chair leg;

a second base clamp, the second base clamp being attached to the second chair leg;

a base, the base having a base horizontal portion, the base horizontal portion being attached in the first base clamp and being attached in the second base clamp, the base horizontal portion extending along a base horizontal axis, the base horizontal portion being rotatable about the base horizontal axis, and the base having a base upward portion, the base upward portion extending along a base upward axis and the base upward portion being attached to the base horizontal portion;

an arm, the arm having an arm horizontal portion, and the arm having an arm downward portion, the arm downward portion being attached to the arm horizontal portion, the arm downward portion being attached to the base upward portion with the arm downward portion being rotatable about the base upward axis and movable along the base upward axis; and a deck, the deck being attached to the arm horizontal portion with the deck being rotatable about the arm horizontal portion, the deck having four adjustments, a first adjustment being movement of the deck along an arc centered on the arm horizontal portion, the second adjustment being movement of the deck along an arc centered on the base horizontal axis, the third adjustment being movement of the deck along an arc centered on the base upward axis, and the fourth adjustment being movement of the arm downward portion along the base upward axis, the first adjustment, the second adjustment, and the third adjustment being achievable simultaneously by only a single manual force applied to the deck only.

2. The holder of claim 1 further comprising at least one auxiliary deck rotatably attached to the arm horizontal portion with the auxiliary deck being rotatable about the arm horizontal portion.

3. The holder of claim 1 further comprising an extender, the extender being fixedly attached to the base upward portion, and the arm downward portion being rotatably and movably attached to the base upward portion by being rotatably and movably attached to the extender, the arm downward portion being rotatable about the extender and being movable along the extender.

4. The holder of claim 1 further comprising a deck edge, the deck edge being attached to the deck in a slot along the deck.

* * * * *